US006581929B2

(12) United States Patent
Hiramitsu

(10) Patent No.: US 6,581,929 B2
(45) Date of Patent: Jun. 24, 2003

(54) POSTURE CORRECTION DEVICE FOR CORRECTING A POSTURE OF CONVEYED PAPER-LIKE MATERIAL AND PAPER-LIKE MATERIAL PROCESSING APPARATUS PROVIDED WITH A POSTURE CORRECTION DEVICE

(75) Inventor: Naruaki Hiramitsu, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/899,851

(22) Filed: Jul. 9, 2001

(65) Prior Publication Data

US 2002/0060417 A1 May 23, 2002

(30) Foreign Application Priority Data

Sep. 14, 2000 (JP) ..... 2000-280843

(51) Int. Cl.[7] ..... B65H 5/00
(52) U.S. Cl. ..... 271/228; 271/225
(58) Field of Search ..... 209/534; 271/227, 271/228, 234, 235, 236, 245, 246, 253, 254, 255, 248, 250, 251, 225

(56) References Cited

U.S. PATENT DOCUMENTS 4,483,530 A * 11/1984 Spencer et al. ..... 271/184
4,836,527 A * 6/1989 Wong ..... 271/248
4,877,234 A * 10/1989 Mandel ..... 271/184
5,219,159 A * 6/1993 Malachowski et al. ..... 271/228
5,381,021 A * 1/1995 Polidoro ..... 250/559.37
5,680,935 A * 10/1997 Mistander et al. ..... 209/534
5,697,609 A * 12/1997 Williams et al. ..... 271/228
5,755,437 A * 5/1998 Ek ..... 198/395
6,053,494 A * 4/2000 Baskette et al. ..... 271/251
6,357,742 B1 * 3/2002 Ogasawara ..... 271/225

FOREIGN PATENT DOCUMENTS

JP 6-1498 * 1/1994

* cited by examiner

*Primary Examiner*—Patrick H. Mackey
(74) *Attorney, Agent, or Firm*—Pillsbury Winthrop LLP

(57) ABSTRACT

A posture correction device includes a detector configured to detect the state of posture of conveyed paper-like material and correction mechanisms configured to correct the posture of paper-like material according to the detected state of posture of paper-like material. The posture correction mechanisms include a correction roller pair configured to clamp and convey the paper-like material, a support frame configured to support the correction roller pair, a first driving mechanism provided separately from the support frame configured to rotate and drive the correction roller pair, and a second driving mechanism configured to tilt the correction roller pair by a prescribed angle in the paper-like material conveying direction by rotating the support frame.

19 Claims, 13 Drawing Sheets

POSTURE CORRECTION DEVICE FOR CORRECTING A POSTURE OF CONVEYED PAPER-LIKE MATERIAL AND PAPER-LIKE MATERIAL PROCESSING APPARATUS PROVIDED WITH A POSTURE CORRECTION DEVICE

BACKGROUND OF THE INVENTION

1. Filed of the Invention

The present invention relates to a paper-like material processing apparatus into which paper-like material; for instance, plural kinds of bank notes are input in a lump, the inserted bank notes are taken out one sheet at time, classified and stacked by uniformly arranging directions of the inserted bank notes by kind of money and a posture correction device that is incorporated in, for instance, a paper-like material processing apparatus.

2. Description of the Related Art

Paper-like material such as bank note, merchandise bonds or other securities are circulating and functioning as key media in social and economical activities. A large amount of the paper-like material are collected to specific points and arranged by nominal values or kinds during the circulating process.

For automatic processing as well as labor saving of these arranging activities, a paper-like material processing apparatus has been so far used. This paper-like material processing apparatus accepts paper-like material in loose state input into an insert port in a lump, takes out the inserted sheets one by one and detects kinds of respective paper-like material by a detector. The paper-like material are classified by kind or bundled every 100 sheets.

By the way, paper-like materials are in four-postures; top and bottom, and front and back. In many cases, these paper-like materials are collected in specific circulating points in the state not properly arranged and they have to be segregated and arranged properly.

A conventional processing apparatus has a reversing function for reversing both the front and back sides while conveying them based on the result of detection by a detector in order for making the front and back sides uniform and stack them in the same stackers.

On the other hand, paper-like materials taken out of the insert port, for instance, bank note, merchandise bonds or other securities differ in size depending on nominal values of respective materials. Because of this, if paper-like materials in different sizes were set in a lump in the insert port, it is highly possible that small sized materials may be buried among the maximum size materials and can be shifted/skewed.

Paper-like materials taken out in the mixed state are conveyed by a conveyor belt pair to the detector. The detector reads various kinds of information from the surfaces of paper-like materials conveyed by roller pairs, performs the logical operation of the read information and compares with reference information. Thus, stain, presence of damage, kind (nominal value in case of bank note), 4 directions of top, bottom, front and back of paper-like materials are detected. Much shifted/skewed paper-like materials are rejected because they cannot be detected from various kinds of information.

Further, as disclosed in Japanese Laid-Open Patent Publication (Kokai) No. Hei 3-58984 (laid open on Sep. 9, 1991), the front and back sides are automatically reversed by 180° with a twist belt. According to this reversing mechanism, paper-like materials rotate around the central point of the twist belt as a principle and therefore, before entering and after coming out of the twist belt, the lateral shift is caused on paper-like materials and it is difficult to arrange them uniform in the lateral direction when stacking or binding them.

In order for solving these problems, the function to correct postures of taken out paper-like materials before conveying them to the detector become necessary. Furthermore, from the demand for high speed processing and/or the mass processing, a high speed and highly reliable posture correction device with less variation after the posture correction is required.

The posture correction device is equipped with, for instance, a transmission light sensor array as a detector at its inlet side. The postures of paper-like materials taken out of the insert port are detected by this light sensor array. The posture correction device calculates an amount of shift and a skew angle of paper-like materials from the center line of the conveyor from the result of detection by the light sensor array.

Further, the posture correction device is equipped with, for instance, the first and second correction mechanisms in the same structure on a base. Each of the posture correction mechanism has a U-shape support frame, a drive shaft mounted between both sidewalls that are bent and formed at both ends of the base of this support frame and correction rollers mounted to this drive shaft. Rubber rollers are kept in contact with the upper side of the correction rollers and these rubber rollers are supported between the sidewalls by the shaft. On the outer surface of one sidewall of the support frame, a first stepping motor is installed and this first stepping motor is directly connected to the drive shaft of the correction rollers.

About the central part of the base portion of the support frame is supported by a sub-shaft and this sub-shaft is rotatably held by a housing. When viewed from above, the support frame is supported by the sub-shaft so as to be able to rotate around the intersecting point of the center line of the conveying path with the roller axial line. A second driving motor is connected to the lower end of the sub-shaft by way of a pulley and a belt.

When the first driving motor is driven, the sub-shaft is rotated via the pulley, belt and pulley, the support frame is rotated by a prescribed angle and thus, the shift and skew of a paper-like material are corrected.

However, in a conventional technology, the first driving motor is installed at the outer surface of one sidewall of the support frame. As the driving shaft of this first driving motor is directly connected to the correction roller shaft, when the support frame was rotated around the intersecting point of the center line of the conveying path with the roller axial line, its moment of inertia became large.

The number of sheets taken out per unit time, that is, the number of sheets that can be processed by the processing apparatus is determined by the time required for correcting the posture of a sheet. In the conventional technology, the time required for rotating the support frame by a required angle is long because the inertia of the support frame is large. Accordingly, the posture of bank notes having much skew or shift can not be corrected.

So, for correcting postures paper-like materials having much skew or shift, it was necessitated to install a support frame including roller pairs at multiple stages and as a result, the conveying path became long and the apparatus became large in size.

Further, for rotating the support frame having the large moment of inertia including correction roller pairs at a high speed, there was such a problem that an expensive servomotor had to be used as the second driving motor and cost was increased.

SUMMARY OF THE INVENTION

An object of this invention is to provide a posture correction device for enabling the posture correction of paper-like material at a high speed and high accuracy by making the moment of inertia of a support frame small and a paper-like material processing apparatus provided with a posture correction device.

According to this invention, a posture correction device is provided. This posture correction device comprises: a detector configured to detect a posture of conveyed paper-like material; and a posture correction mechanism configured to correct the posture of the paper-like material according to the postures of paper-like material detected by the detector. The posture correction mechanism includes: a correction roller pair configured to convey the paper-like materials by clamping them; a support frame configured to support the correction roller pair; a first driving mechanism, provided separately from the support frame, configured to rotate and drive the correction roller pair; and a second driving mechanism to tilt the correction roller pair by a prescribed angle in the conveying direction of the paper-like materials by rotating the support frame.

Further, according to this invention, a paper-like material processing apparatus is provided. This paper-like material processing apparatus comprises: an insert port configured to accommodate paper-like materials in a lump; a take-out mechanism configured to take out paper-like materials accommodated in the insert port one by one sheet; a conveying mechanism configured to convey the paper-like materials taken out by the take-out mechanism along the conveying path; a detector configured to detect a posture of paper-like materials conveyed by the conveying mechanism; a correction mechanism configured to correct the posture of the paper-like materials according to the posture of paper-like material detected by the detector; and a classifying mechanism configured to classify the paper-like material after the posture was corrected by the posture correction mechanism according to classification information. The posture correction mechanism includes: a correction roller pair configured to convey the paper-like materials by clamping them; a support frame configured to support the correction roller pair; a first driving mechanism, provided separately from the support frame, configured to rotate and drive the correction roller pair; and a second driving mechanism configured to tilt the correction roller pair by a prescribed angle in the conveying direction of the paper-like materials by rotating the support frame.

DETAILED DESCRIPTION OF THE INVENTION

Figure 1:
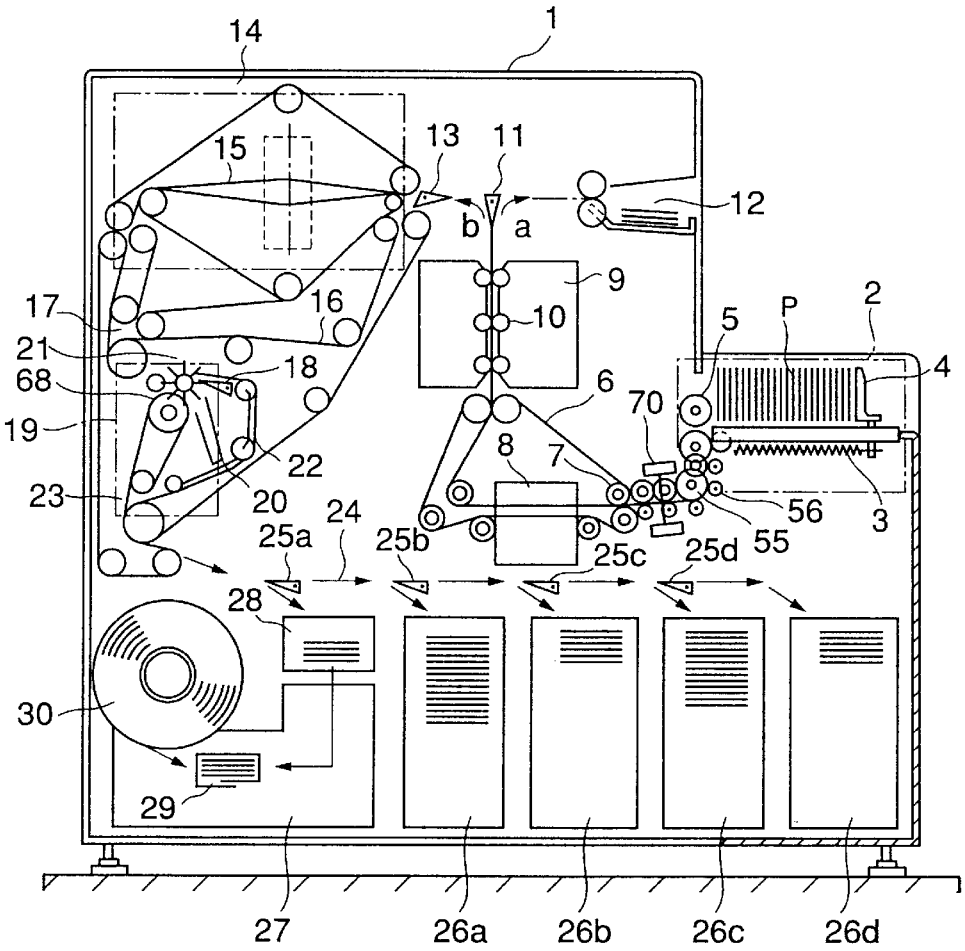
FIG. 1 is an inner structural diagram showing the outline of a bank note processing apparatus that is an embodiment of the paper-like material processing apparatus of the present invention.

The present invention will be described below in detail referring to embodiments shown in the drawings.

FIG. 1 is a structural diagram showing the outline of a bank note classifying & arranging apparatus which is a paper-like material processing apparatus of an embodiment of the present invention.

At the nearly central part of one side of a housing 1, an insert port 2 is provided as an accommodating portion. In the insert port 2, the plural number of sheets of bank notes P are housed in the upright setup state. The insert port 2 is provided with a backup plate 4 that is pressed by a spring 3 and bank notes P are sent out by this backup plate 4. A take-out roller 5 is provided in the send-out direction of bank notes P. Under the take-out roller 5, there are a rubber roller 55 and a roller 56 that is kept in contact with a rubber roller 55. The roller 56 is compressed by a spring and conveys a bank note by clamping it jointly with the rubber roller 55.

In the bank note take-out direction, there is provided a transmission light sensor array 70 for sensing a shift amount and a skew amount of a taken out bank note. The arrangement of the light sensor array 70 will be described later.

After passing through the light sensor array 70, a bank note is fed on a clamp type conveyor 6 that is composed of conveyor belt pairs 49*a*–49*c* (see FIG. 3) and a roller 7. In the conveyor 6, a posture correction device 8 is provided for automatically correcting a shift and a skew of a taken-out bank note P. The construction of the posture correction device 8 will be described later in detail.

The portion of the conveyor 6 passing through the posture correction device 8 is also a conveyor belt pair and a bank note P is restricted here but its clamping force is weak and it does not become a load when correcting the posture of bank note by the posture correction device 8.

Above the conveyor 6, there is provided a detector 9. This detector 9 reads various kinds of information from the surface of bank note P that is conveyed on roller pairs 10, performs the logical computation of the read information, and compares the computed information with those information that become references. From this comparison, dirt, presence of damage, kind of bank note (nominal value) and further, 4 directions of the top, bottom, front and back of bank note are detected.

Above the detector 9, there is provided a first gate 11. This first gate 11 selects the conveying direction of bank note P in the arrow direction a or b. That is, bank notes that are detected not to be proper bank notes by the detector 9 (for instance, two sheets that are taken together, bank notes largely skewed more than a fixed level) are selected for the arrow direction a and led to a rejection box 12.

On the other hand, the arrow direction b is selected for bank notes that are detected by the detector 9 to be proper bank notes and their front sides being on the top. In the arrow direction b, a second gate 13 is provided. This second gate 13 divides the conveying direction of bank notes P in the first and second routes.

In the first route, a both side reversing path 14 is provided. This both sides reversing path 14 is equipped with a twist belt 15 for reversing both sides of bank notes by 180 degrees. In the second route, an ordinary conveying belt 16 is provided and the bank note posture is maintained as it is. The first and second routes are joined into one at a joining portion 17. The first and second routes up to the joining portion 17 are set in the same length so that a pace between preceding and succeeding bank notes after joined does not shift. Below the joining portion 17, a third gate 18 is provided. The bank note conveying route is divided into the third and fourth routes by this third gate 18. The third route is a switchback path 19. The rear end of a bank note led to a reversing box 20 is pushed against a reversing roller 68 by a tapping wheel 21, and its top and bottom portions are reversed and conveyed. The fourth route is merely a conveyor belt 22 and a bank note is conveyed while maintaining the posture as it is.

The third and fourth routes are jointed into one at a joining portion 23. The third and second routes up to the joining portion 23 are set in the same length so that a space between preceding and succeeding bank notes after joined does not shift.

Behind the reversing device mentioned above, there is provided a horizontal conveying path 24. In this horizontal conveying path 24, gates 25*a*–25*d*, less than the number of portions to be divided by one, are arranged. Below the gates 25*a*–25*d*, stackers 26*a*–26*d* are arranged. Paper-like material are stacked horizontally in these stackers 26*a*–26*d* by kind.

A binding device 27 moves paper-like material from a stacker 28 that is capable of stacking and dividing paper-like material for every 100 sheets to a binding unit 29 and bundles paper-like material by a paper strip supply portion 30.

Figure 2:
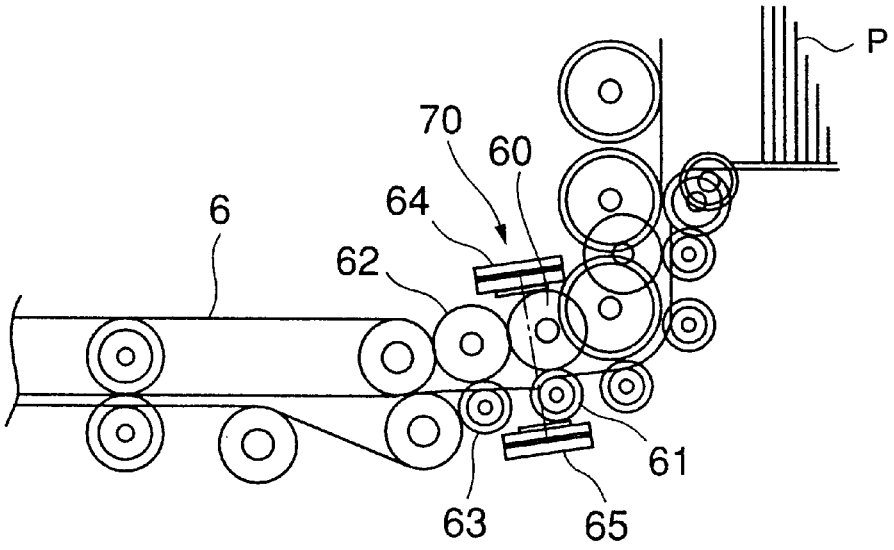
FIG. 2 is a front view showing a bank note sensor provided in the conveying path of bank notes taken out of the insert port.
Figure 3:
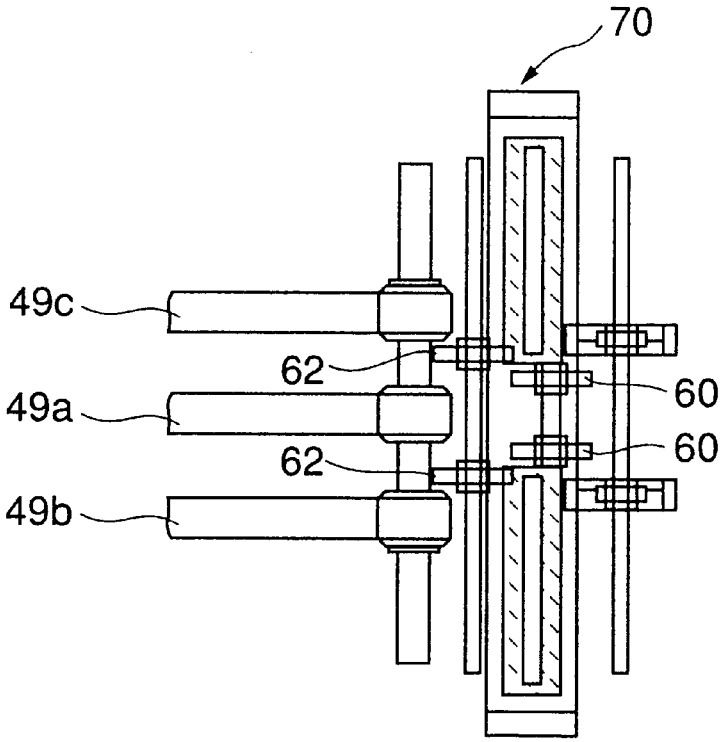
FIG. 3 is a bottom view showing the bank note sensor provided in the conveying path of bank notes taken out of the insert port.

FIG. 2 is a front view showing the arranged state of the light sensor array 70 and FIG. 3 is its bottom surface diagram.

Of first to third conveyor belt pairs 49*a*–49*c* of the conveyor 6 passing through the posture correction device 8, the first conveyor belt pair 49*a* is positioned on the center and the second and third conveyor belt pairs 49*b* and 49*c* are arranged at the symmetrical positions at both sides of the first conveyor belt pair 49*a* at a fixed pitch. At the bank note induction sides of the first to third conveyor belt pairs 49*a*–49*c*, rubber rollers 60 are arranged and rubber rollers 61 that are compressed by springs (not shown) are brought in contact with the rubber rollers 60. Between the rollers 60 and the first to third conveyor belts 49*a*–49*c*, rubber rollers 62 are provided. Rubber rollers 63 that are compressed by springs (not shown) are brought in contact with the rubber rollers 62.

At the bank note induction sides of the first to third conveyor belt pairs 49*a*–49*c*, the light sensor array 70 is provided. This light sensor array 70 is composed of a light receiving sensor 64 and an LED 65. The light receiving sensor 64 and the LED 65 are attached to a base via a plate (not shown). The light receiving sensor 64 and the LED 65 are housed in a tightly closed case of which conveying surface side is a glass plate for preventing entry of dust. The light sensor array 70 is arranged over the whole conveying area excluding the first conveyor belt pairs 49*a*.

Figure 4:
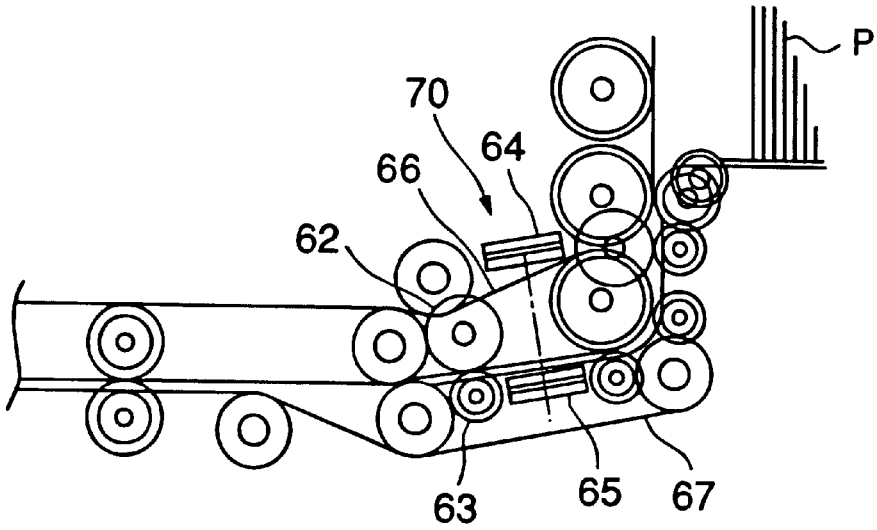
FIG. 4 is a front view showing a second example of the bank note sensor provided in the conveying path of bank notes taken out of the insert port.
Figure 5:
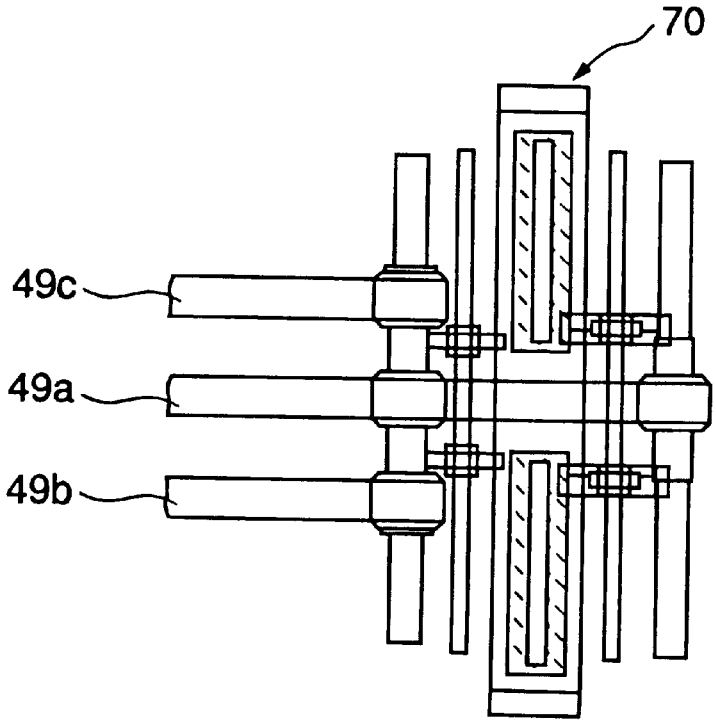
FIG. 5 is a bottom view showing the second example of the bank note sensor provided in the conveying path of bank notes taken out of the insert port.

FIG. 4 and FIG. 5 show an example of a second arrangement of the light sensor array 70.

In this second example of the arrangement, the glass plate surface of the LED 65 side case is arranged near the conveying path and a bank note is conveyed by the conveyor belt pairs 66 and 67 on the center line of the conveying path. When passing the glass plate surface, a bank note contacts the glass plate surface and removes dust on the glass plate surface.

Figure 6:
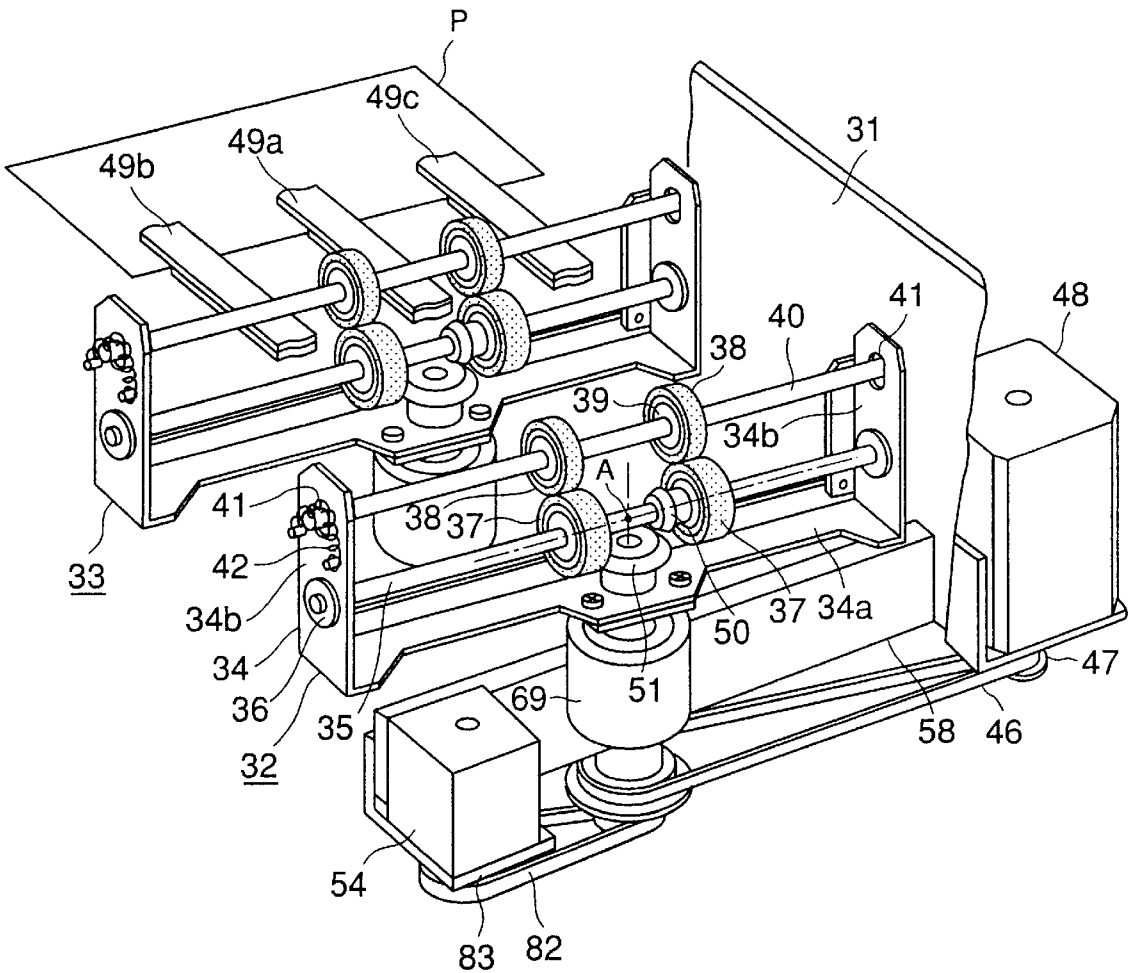
FIG. 6 is a perspective view showing a first embodiment of a posture correction device of the present invention.
Figure 7:
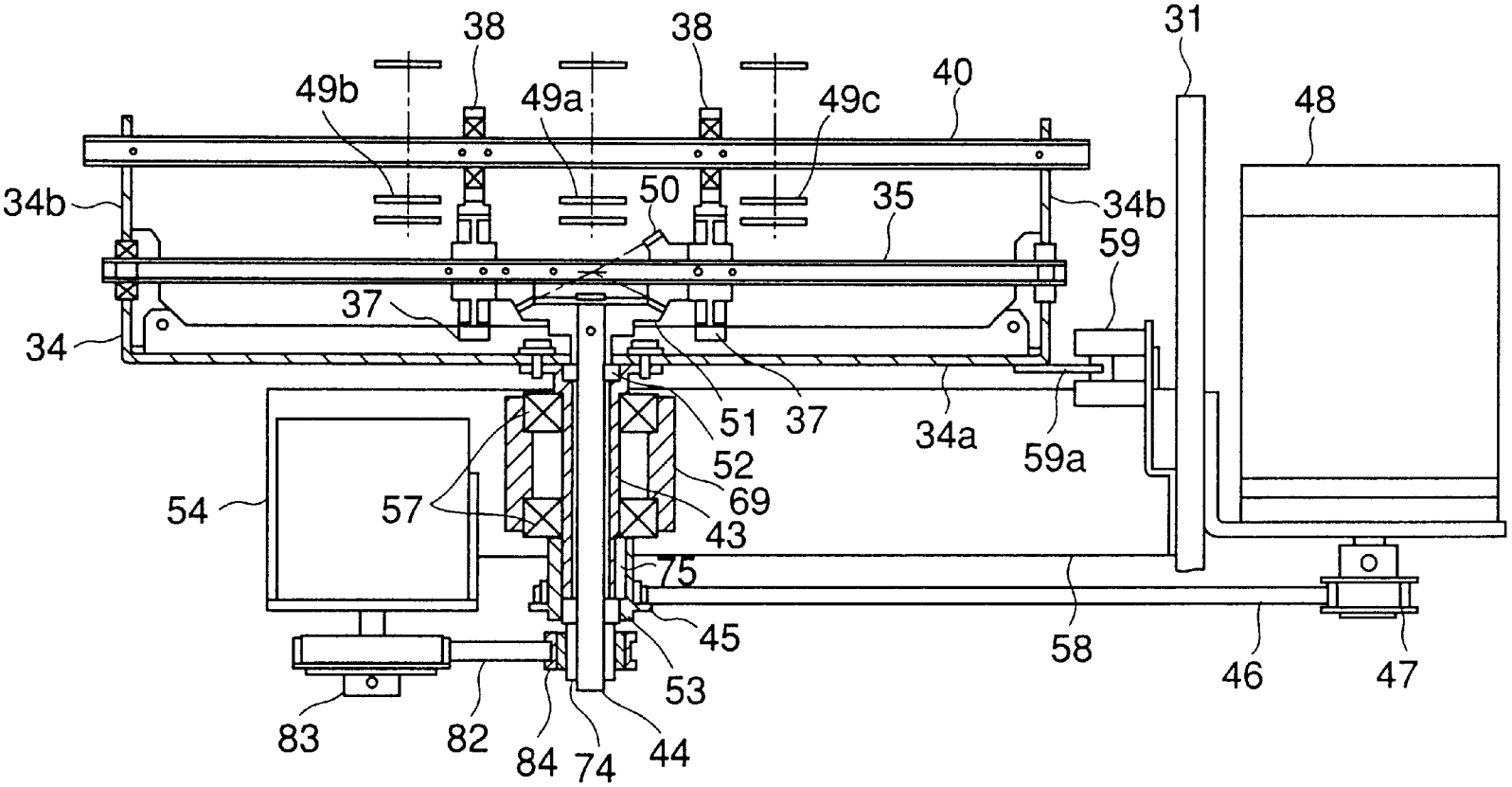
FIG. 7 is a side sectional view of the posture correction device shown in FIG. 6.

FIG. 6 is a perspective view showing the posture correction device 8 and FIG. 7 is its vertical sectional view.

The posture correction device 8 has a first and second correction mechanisms 32 and 33. The first and second correction mechanisms 32 and 33 are in the same structure and mounted to a base 31. Since the first and second correction mechanisms 32 and 33 are in the same structure, the first correction mechanism 32 will be explained here.

The first correction mechanism 32 has a U-shape frame (hereinafter referred to as a support frame) 34 that is composed of a frame base portion 34*a* which is longer than the bank note width and side walls 34*b* which is bent to both sides.

Between side walls 34*b*, a drive shaft 35 is put via bearings 36 and rollers 37 are mounted to the drive shaft 35. The outer surfaces of the rollers 37 are made of rubber in order to increase frictional force. Rubber rollers 38 are in contact with the upper sides of the rollers 37. The rubber rollers 38 are mounted to a shaft 40 via bearings 39. Both ends of the shaft 40 are fitted in bearing grooves provided on the side walls 34*b* of the support frame 34 and compressed downward by springs 42. The rollers 37 and the rubber rollers 38 comprise a correction roller pair.

The correction roller pairs 37 and 38 are provided between first and second conveyor belt pairs 49*a* and 49*b* and between the first and third conveyor belt pairs 49*a* and 49*b* passing through the posture correction device 8, respectively. The correction roller pairs 37 and 38 are arranged at symmetrical positions of both sides of the first conveyor belt pair 49*a*.

A bevel gear 50 is stationary mounted to the drive shaft 35 and a bevel gear 51 is meshing with this bevel gear 50. The bevel gear 51 is fixed on the upper end of a first drive shaft 44 as shown in FIG. 7. The shaft 44 is provided vertically and its upper end is facing to the center of the drive shat 35 of the rollers 37. The shaft 44 is inserted in a cylindrical shaft 43 that is a second drive shaft and is kept rotatably by the upper and lower bearings 52 and 53. The lower bearing 53 is mounted to a pulley 45 that is fixed to the cylindrical shaft 43. At the lower end of the shaft 44, a pulley 84 is mounted via a one-way clutch 74. The pulley 84 is connected with a stepping motor 54 as a first driving motor via a belt 82 and a pulley 83.

When the stepping motor 54 is driven, the shaft 44 is rotated by way of the pulley 83, the belt 82 and the pulley 84. By the rotation of the shaft 44, the drive gear 35 is rotated by way of the bevel gears 51 and 50 and the correction roller pairs 37 and 38 are rotated. As a result of the rotation of the correction roller pairs 37 and 38, a bank note is clamped and conveyed.

The clamping force of the correction roller pairs 37 and 38 of the posture correction device 8 is so set that it becomes stronger than the clamping force of the conveyor belt pairs 49*a*~49*c*.

The cylindrical shaft 43 is held rotatably in the housing 69 via a bearing 57. The central portion of the frame base portion 34*a* of the support frame 34 is fixed to the upper end of the cylindrical shaft 43. A sunk key 75 is inserted in between the cylindrical shaft 43 and the pulley 45 to fix the pulley 45 to the cylindrical shaft 43. A stepping motor 48 as a second driving motor is connected to the pulley 45 via a driving belt 46 and a pulley 47. The housing 69 is fixed to the base 31 via a mounting base 58. A sensor 59 is mounted to the base 31 and a detected member 59*a* is mounted to the frame base portion 34*a* for turning the sensor 59 ON/OFF.

When the stepping motor 48 is driven, the cylindrical shaft 43 is rotated via the pulley 48, the driving belt 46 and the pulley 45. When the rotation of the cylindrical shaft 43 is rotated, the support frame 34 is rotated and the direction of the correction roller pairs 37 and 38 is changed. The amount of rotation of the support frame 34 is controlled by detecting the detected member 59*a* by a sensor 59.

Figure 8:
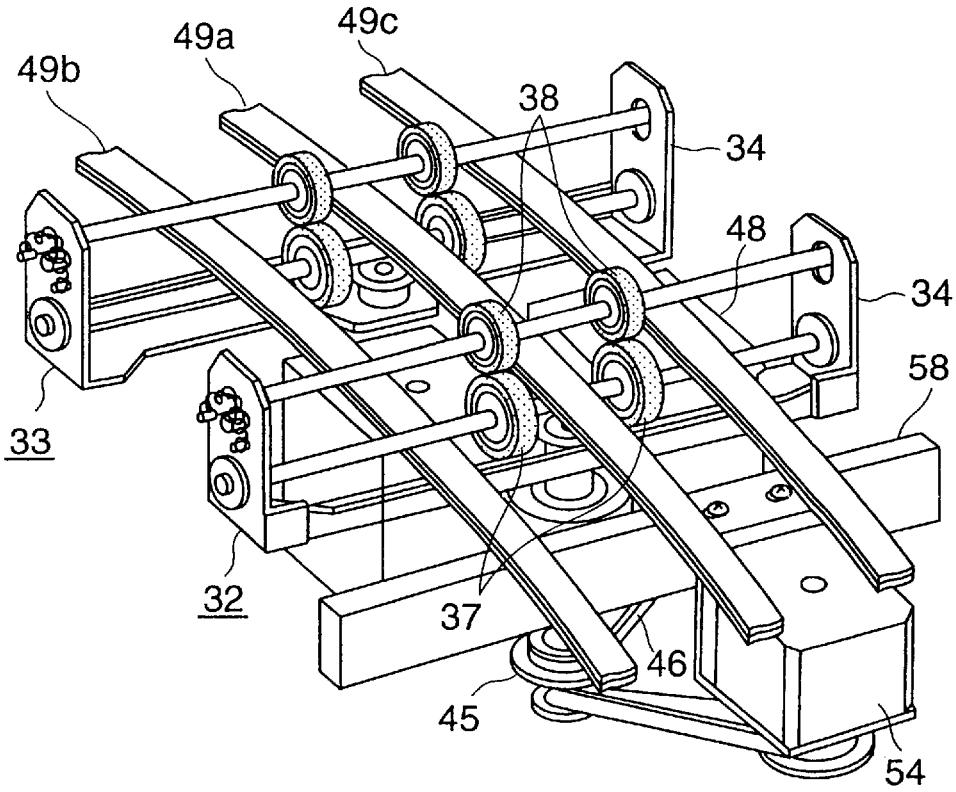
FIG. 8 is a perspective view showing a second embodiment of the posture correction device of the present invention.

FIG. 8 is a perspective view showing a second embodiment of the posture correction device of this invention.

The same portions explained in the first embodiment of the posture correction device of this invention will be assigned the same reference numerals and the explanation thereof will be omitted.

In the second embodiment, the second stepping motor 48 is installed close to the center of the rotation A of the support frame 34.

In the first embodiment described above, as the second stepping motor 48 is installed far away from the center of the rotation A of the support frame 34, the length of the driving belt 46 becomes long. Therefore, the vibration of the driving belt 46 when stopping the second stepping motor 48 becomes large and as a result, the vibration of the support frame 34 becomes large. Accordingly, the operation for returning the support frame 34 in the reverse direction has to be started after the vibration is reduced and as a result, process efficiency will drop.

So, in this second embodiment, the second stepping motor 48 is provided directly below the conveyor belt pairs 49*a*~49*c* between the first and second correction mechanisms 32 and 33 close to the center of rotation A of the support frame 34. Thus, the length of the driving belt 46 can be made shorter than the first embodiment and the vibration when stopping the second stepping motor 48 can be reduced.

Accordingly, a time required for waiting until the vibration decreases can be reduced, the start to operate the support frame 34 can be quickened and the correction process can be made at a higher speed. In addition, as a result of reduced vibration of the stepping motor 48 when stopping, accuracy of the posture correction of this invention can be improved.

Figure 9:
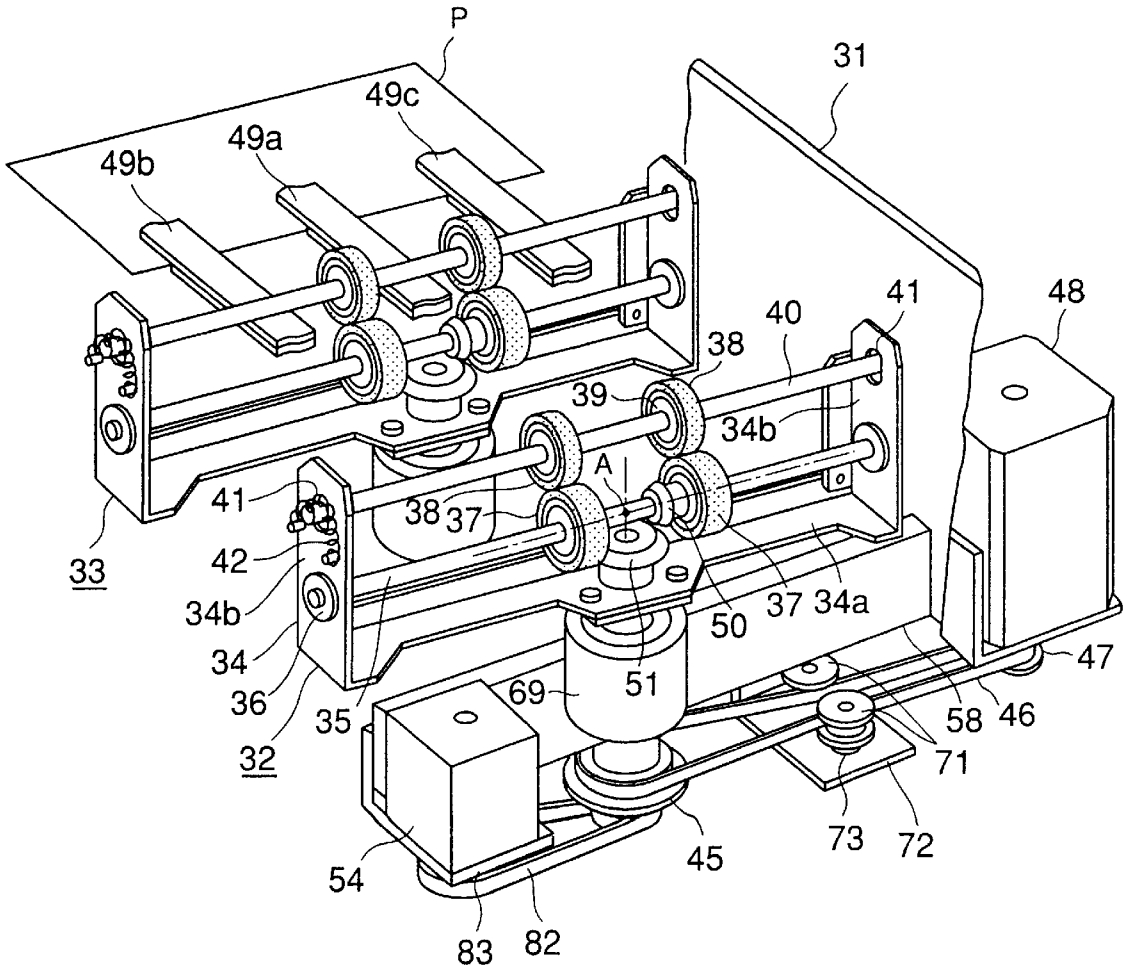
FIG. 9 is a perspective view showing a third embodiment of the posture correction device of the present invention.

FIG. 9 is a perspective view showing a third embodiment of the posture correction device of his invention.

This third embodiment is effective when the second stepping motor 48 cannot be installed at the position shown in the second embodiment for a restricted space, etc. of a bank not processing apparatus.

In the third embodiment, the second stepping motor 48 is installed at the outside of the base 31 likewise the first embodiment.

The mounting base 58 is provided with a frame 72. A pin 73 is projected from this frame 72. The pin 73 is provided with a pair of idle roller 71. These idle rollers 71 are arranged adjustably at middle positions between the pulleys 45 and 47. The driving belt 46 is put over the idle rollers 71 and its tension is adjustable. Thus, the vibration of the driving belt 46 when the second stepping motor 48 is stopped is reduced.

Figure 10:
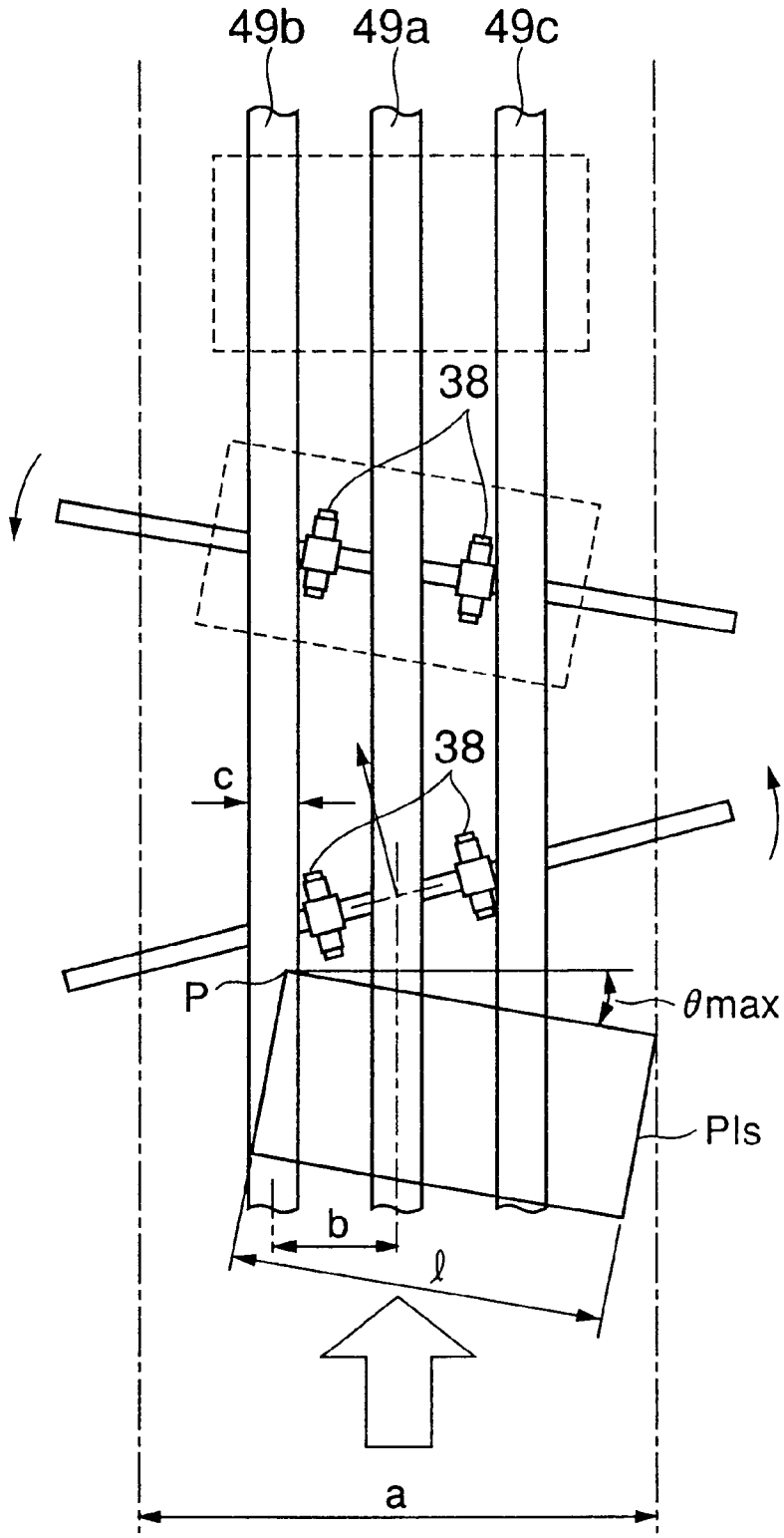
FIG. 10 is a plan view showing the relation of arrangement of a posture correction device with conveyor belt pairs.

FIG. 10 is a diagram showing the relation of the arrangement of the posture correcting roller pairs 37 and 38 with the conveyor belt pairs 49*a*–49*c*.

The first conveyor belt pair 49*a* is laid on the center line of the conveying path and the correction roller pairs 37 and 38 are arranged symmetrically at its outside against the center line. Further, at the outside of the correction roller pairs 37 and 38, two conveyor belt pairs 49*b* and 49*c* are arranged symmetrically against the conveying center line.

Here, it is assumed that paper PIs that is in the minimum size handled by the bank note processing apparatus are shifted up to either end of the conveying path width that can be conveyed by the apparatus and taken out in the state of maximum skew angle θ max that can be conveyed by the apparatus.

At this time, the corner p of a bank note at the proceeding direction side is on the second conveyor belt pair 49*b* that is laid at the outside of the posture correction roller 38 against the conveying center line.

When the width that can be conveyed by the apparatus is a, the conveyor belt pitch is b, the conveyor belt width is c, the length of paper in the minimum size handled by the apparatus in the longitudinal direction is land the maximum skew angle that can be conveyed by the apparatus is θ max, the following relation is held good:

$$l \cdot \cos \theta\max - a/2 > b - c/2 \qquad \text{Equation (1)}$$

If the equation (1) does not hold good, when the shift of a bank note PIs is corrected by the correction rollers 38, its corner P collides with the end surface of the conveyor belt pair 49*b* or runs on it, not only bending the corner but also causing the conveying jam.

Figure 11:
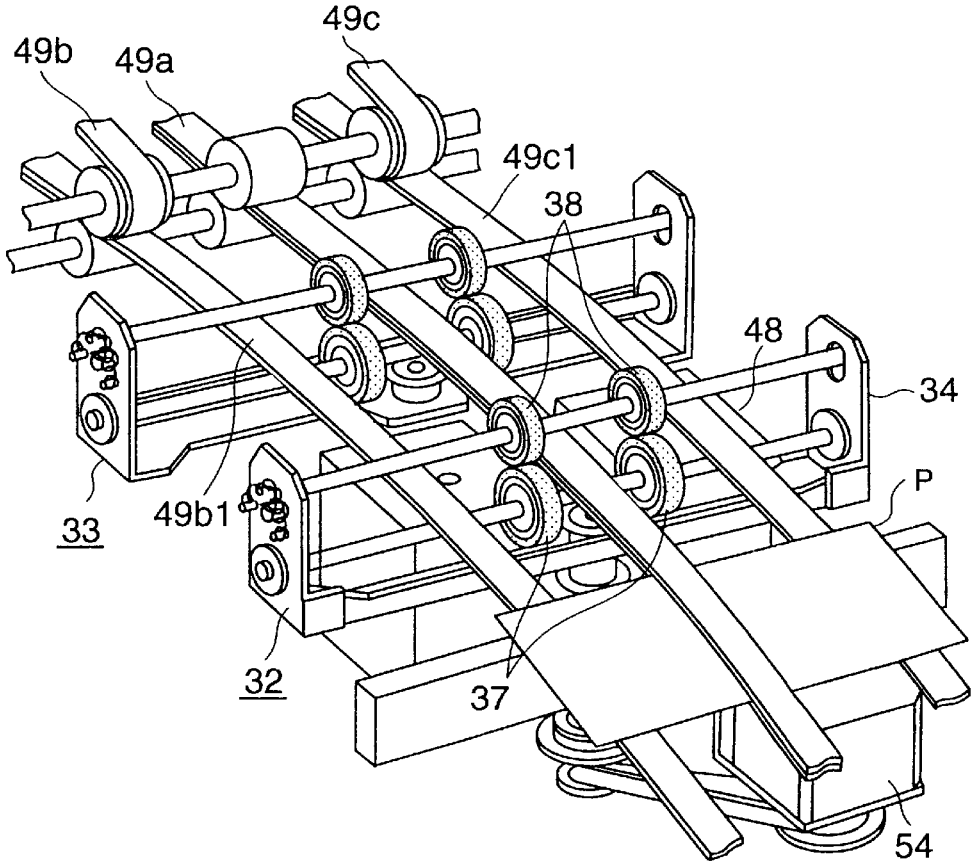
FIG. 11 is a perspective view showing a fourth embodiment of the posture correction device of the present invention.

FIG. 11 shows a fourth embodiment of the posture correction device 8 of this invention.

In the fourth embodiment, of three conveyor belt pairs 49*a*–49*c*, the portions of the conveyor belt pairs 49*b* and 49*c* laid at the outside of the correction rollers 37 and 38 against the conveying center line and positioned at the posture correction device 8 are not in the form of conveyor belt pairs and lower side belts 49*b*1 and 49*c*1 only exist.

When the position correction device handles bank notes that are weak in toughness, if the second and third conveyor belts 49*b* and 49*c* at the outside are paired belts in the correction area when the posture is corrected by the correction roller pairs 37 and 38, they become friction resistance and bank notes can be wrinkled during the posture correction.

Further, if a large slew in excess of the skew angle θ max shown in FIG. 10 is generated or a corner is largely bent when taking out bank notes, Equation (1) does not hold good and the corner p comes off the conveyor belt. Even when the positional shift is corrected when bank notes are in this state, the conveying jam can be avoided according to this fourth embodiment.

Figure 12:
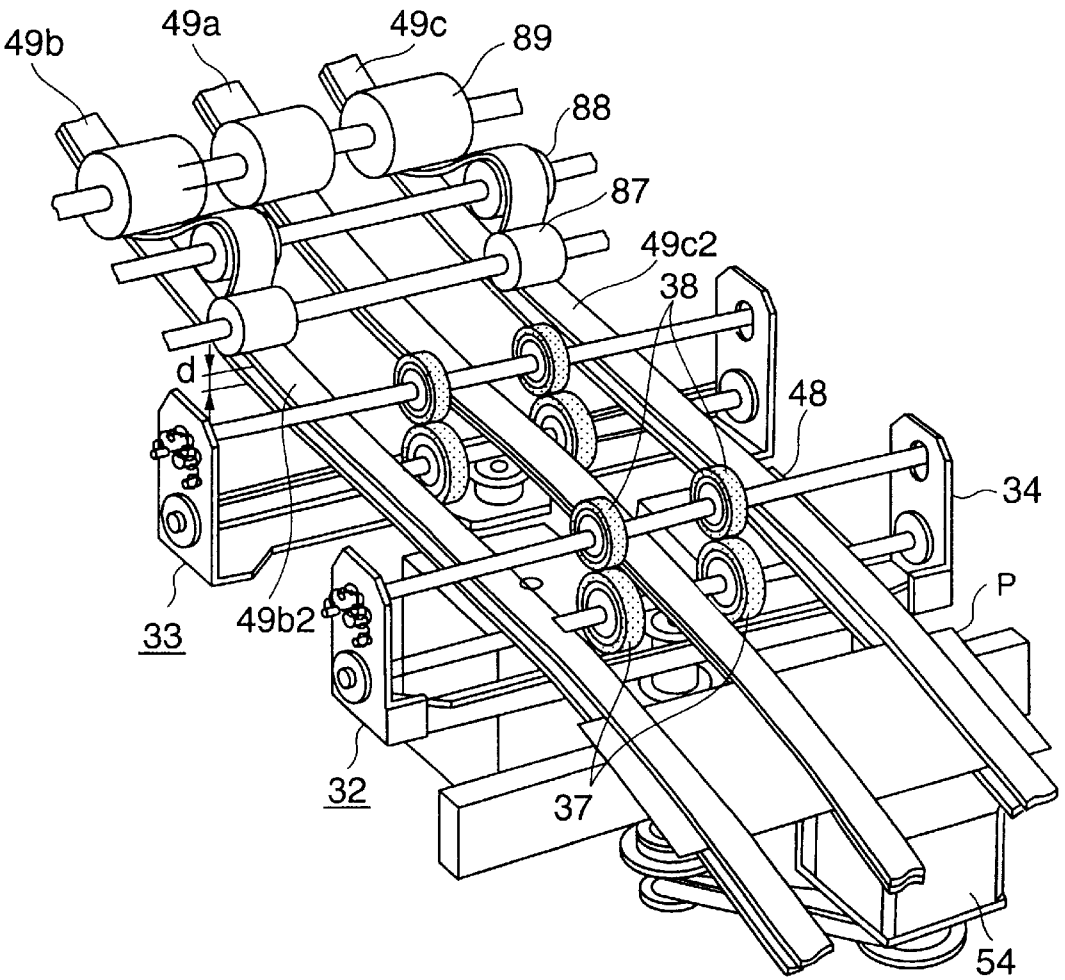
FIG. 12 is a perspective view showing a fifth embodiment of the posture correction device of the present invention.

FIG. 12 shows a fifth embodiment of the posture correction device 8 of this invention.

In the fifth embodiment, a clearance d is formed between the second and third conveyor belt pairs 49*b* and 49*c* laid at the outside of the correction roller pairs 37 and 38 against the conveying center line in the correction area.

The upper side belt portions of the second and third conveyor belt pairs 49*b* and 49*c* are wound round the idle rollers 87 and 88 and the clearance d is secured between the conveyor belt pairs 49*b* and 49*c* in the position correction device 8.

According to the fifth embodiment, the same effect as that explained in the fourth embodiment is obtained and in addition, the upper side belts 49*b*2 and 49*c*2 of the second and third conveyor belt pairs 49*b* and 49*c* act as the upper side guides that move at the conveying speed of a bank note P.

Accordingly, the upward turn-over of the corner of a bank note P can be prevented and as a result, generation of bending of a bank note when entering into the rollers 89 can be prevented.

Here, the operation for stacking bank notes P taken out of the insert port 2 by aligning 4 kinds of directions will be described referring to FIG. 13 through FIG. 16.

Figure 13:
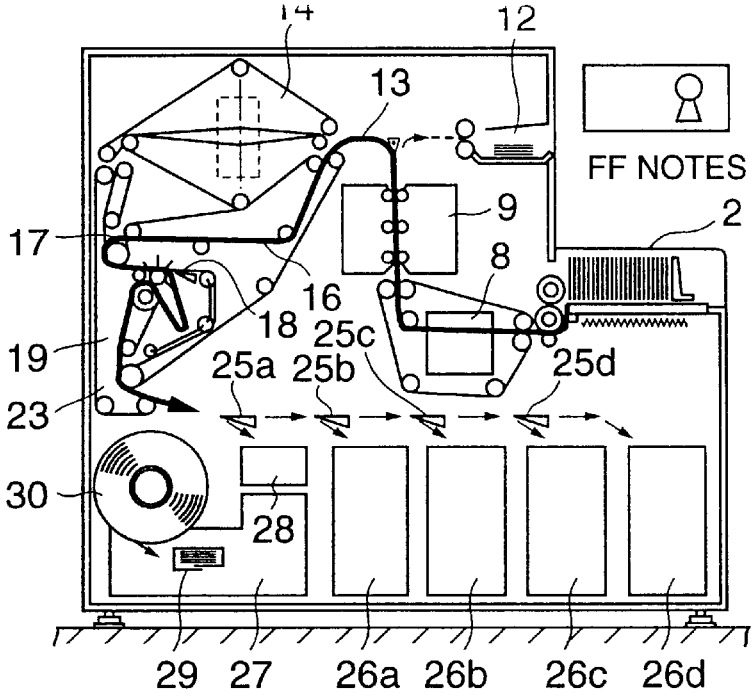
FIG. 13 is an outline diagram showing an FF note processing route in the bank not processing apparatus shown in FIG. 1.
Figure 14:
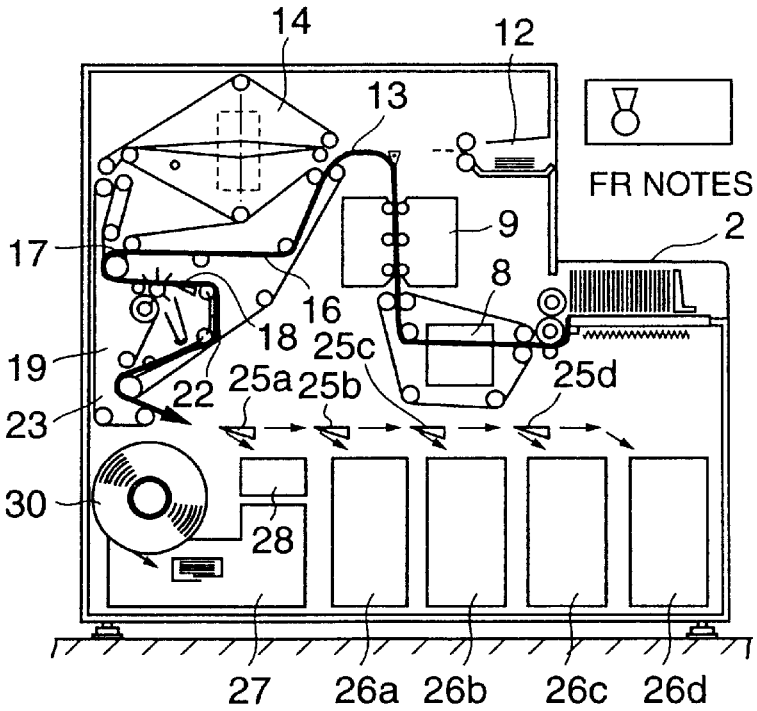
FIG. 14 is an outline diagram showing an FR note processing route in the bank note processing apparatus shown in FIG. 1.
Figure 15:
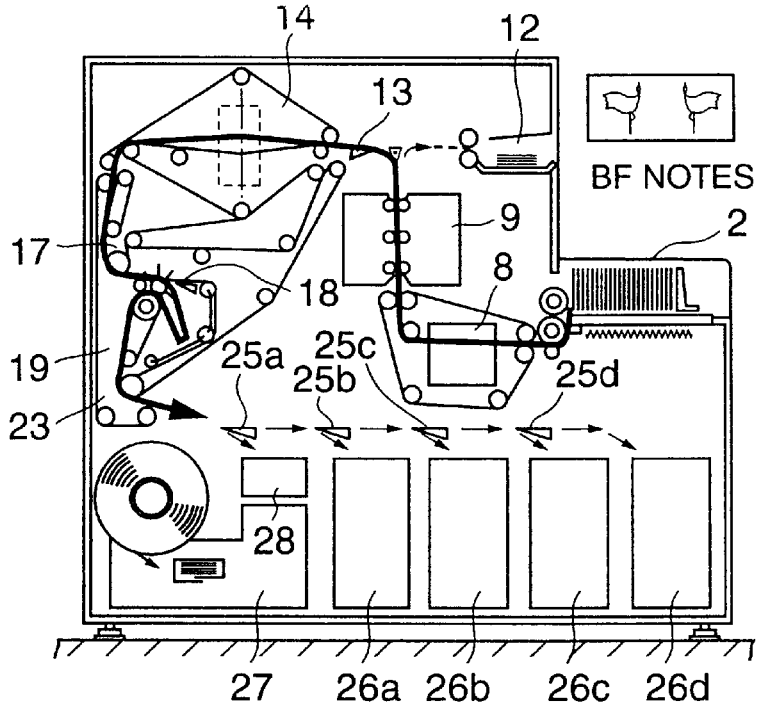
FIG. 15 is an outline diagram showing a BF note processing route in the bank note processing apparatus shown in FIG. 1.
Figure 16:
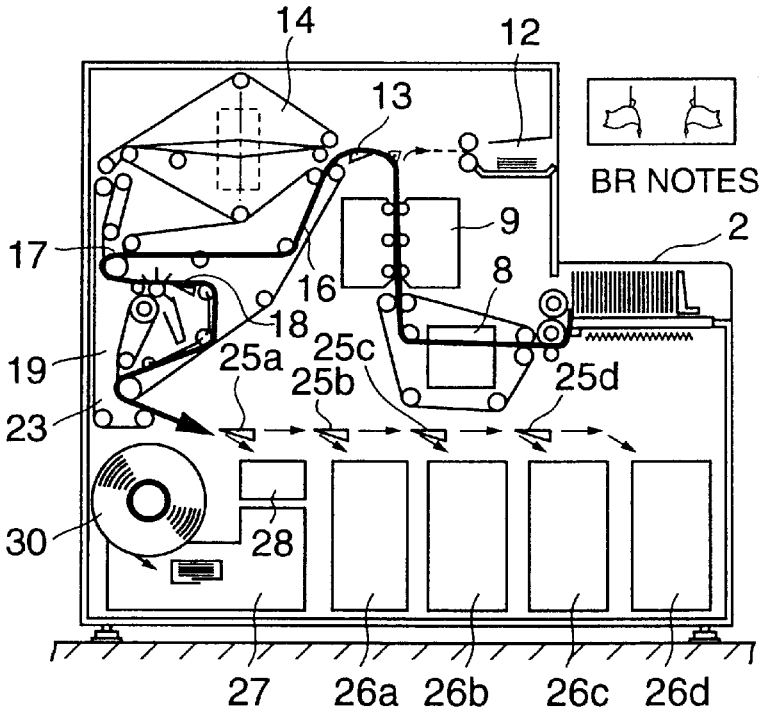
FIG. 16 is an outline diagram showing a BR note processing route in the bank note processing apparatus shown in FIG. 1.

In FIG. 13, a processing route of FF notes taken out with the surfaces placed upward and the upper ends at the top is shown. In FIG. 14, a processing route of FR notes taken out with the surfaces placed upward and the bottom end at the top is shown. In FIG. 15, a processing route of BR notes taken out with the back placed upward and the bottom ends at the top is shown. In FIG. 16, a processing route of BR notes taken out with the back placed upward and the bottom ends at the top.

As shown in FIG. 13, when a bank note P taken out of the insert port 2 is detected to be an FF note by the detector 9, this FF note passes on the conveying belt 16 via the second gate 13. The FF note passed the conveying belt 16 is led to a switchback path 19 via the joining portion 17 and the third gate 18, and sent out after its top and bottom are reversed. The FF note sent out from the switchback path 19 passes the joining portion 23 and then, classified and stacked in prescribed stackers 28, 26*a*–26*d* as the gates 25*a*–25*d* are selectively switched according to the result of the detector 9.

As shown in FIG. 14, when a bank note P taken out of the insert port 2 is detected by the detector 9 to be an FR note, this FR note passes a both side reversing path 14 and sent out after its front and back are reversed. The FR note sent out from the both side reversing path 14 passes on the conveyor belt 22. The FR note passed on the conveyor belt 22 is classified and stacked in the prescribed stackers as the switching the gates 15*a*–15*d* are selectively switched according to the result of detection by the detector 9 after passing the joining portion 23.

As shown in FIG. 15, the bank note P taken out of the insert port 2 is detected to be a BF note by the detector 9, this BF note passes the both side reversing path 14 via the second gate 13 and sent out after its front and back are reversed. The BF note sent out from the both side reversing path 14 is led to the switchback path 19 via the joining portion 17 and the third gate 18, and sent out after its top and bottom are reversed. The BF note sent out from the switchback path 19 is classified and stacked in the prescribed stackers 28, 26*a*–26*d* as the gates 15*a*–15*d* are selectively switched according to the result of detection by the detector 9 after passing the joining portion 23.

As shown in FIG. 16, when a bank note P taken out of the insert port 2 is detected by the detector 9 to be a BR note, this BR note passes on the conveying belt 16 via the second gate 13. The BR note passed the conveying belt 16 passes the conveyor belt 22 via the joining portion 17 and the third gate 18. The BR note passed the conveyor belt 22 is classified and stacked in the prescribed stackers 28, 26*a*–26*d* as the gates 25*a*–25*d* are selectively switched according to the result of the detection by the detector 9 after passing the joining portion 23.

The sizes of bank notes, other notes, etc. differ depending on face values and therefore, if they are set in a lump in the insert port 2, even when they are aligned manually, small size notes are buried among maximum size notes and they may be possibly shifted or skewed. Bank notes taken out from such set state will be sent out in the shifted or skewed state.

Figure 17:
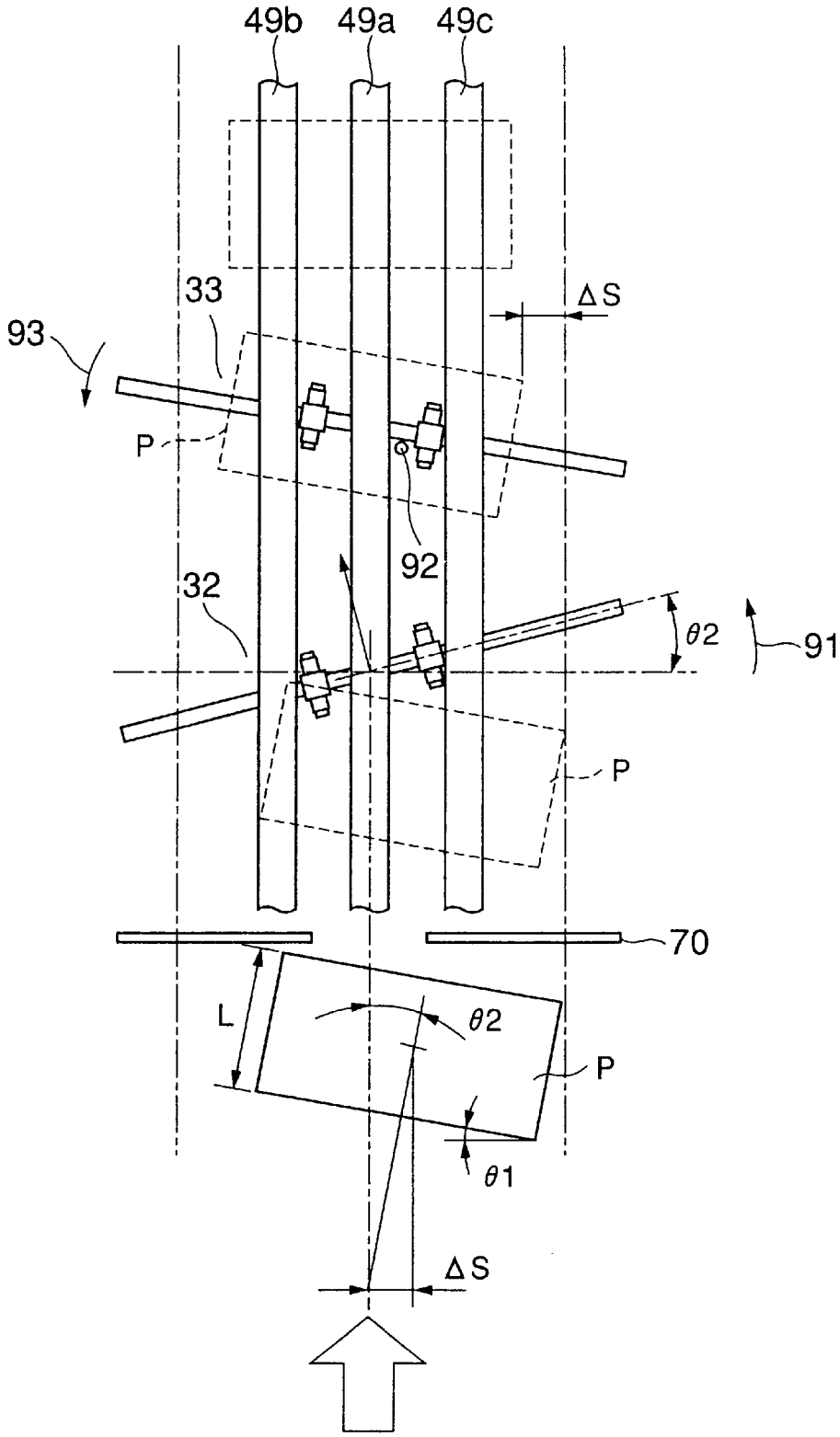
FIG. 17 is a plan view for explaining the operation for correcting the bank note conveying postures by the posture correction device.

The bank notes sent out in this state are conveyed on the first to third conveyor belt pairs 49*a*–49*c* to the posture correction device 8. At this time, the correction roller pairs 37 and 38 are rotated at a velocity equal to the peripheral velocity of the conveyor belt pairs 49*a*–49*c* by the first stepping motor. Further, the postures of the bank notes introduced into the posture correction device 8 are detected by the transmission light sensor array 70. Then, from the result of this detection, a shift ΔS mm and a skew angle θ1 from the conveying center line are calculated. If the detected result of a length of bank notes in the longitudinal direction is shorter than those of bank notes that can be processed by the apparatus, these bank notes are conveyed to the rejection box 12 without the postures correction because they are regarded to be bent or cut bank notes. Then, θ2 of tan θ2=Δs/L is calculated, where L is a width of bank note. The second stepping motor 48 is driven so that the first correction mechanism 32 is rotated in an arrow direction 91 as shown in FIG. 17.

Thus, even when the cylindrical shaft 43 and the shaft 44 are rotated in the reverse directions each other, the rotating velocity of the first correction mechanism 32 remains unchanged because the one way clutch runs idle. A bank note adhered to this first correction mechanism 32 corrects the shift by shifting in the direction shifted by an angle θ2 from the conveying direction while maintaining its skew angle. Then, the tip of the bank note passes a sensor 92 and rotates the second correction mechanism 33 at a prescribed timing in the arrow direction 93. The skew is corrected when the correction rollers are rotated in the state by clamping the bank note.

By a series of control operations described above, the skew and shift are corrected successively and a bank note which has originally no skew or shift is conveyed to the next detector 9 by keeping a correct posture with the first and second correction mechanisms 32 and 33 not rotated. As a bank note is conveyed to the detector 9 in the state without skew or shift, information obtained from the surface is stable and it is easy to make the judgment of kind, front and back, top and bottom of the bank note and logical calculation.

According to the result of the judgment of the detector 9, the processing routes shown in FIG. 13 to FIG. 16 are set up and bank notes pass prescribed conveying paths by operating respective gates according to the setup. Bank notes pass the both side reversing path 14, switchback path 19, etc. as necessary and when entering into a horizontal conveying path 24, all bank notes are in the state with the front and back, top and bottom aligned.

That is, the stackers 26*a*–26*c* are able to stack all bank notes horizontally in the aligned front/back and top/bottom and the binding device 27 is able to bind every 100 sheets in the front/back and top/bottom aligned state.

Further, the posture correcting operation described above is capable of correcting skew and shift only by the first correction mechanism 32 when amount of skew/shift of bank notes is less, and the sequence of correction can be changed without restricting the correcting sequence of skew/shift by the first and second correction mechanisms.

Further, when much shift of bank note is taken place extremely, it is sufficient to provide correction mechanisms at much more stages not limiting to the first and second correction mechanisms 32 and 33 and the number stages of the posture correction mechanism is not restricted.

Further, in the above embodiments, the shift was corrected based on the center line of the conveyor belt but the correction can be made based on, for example, the right side base only by changing a control angle and any skew and shift can be corrected freely and the longish conveyance can be changed to the shortish conveyance.

Furthermore, it is also possible to increase the conveying force by widening the width of the first conveyor belt pair 49*a* at the center of three conveyor belt pairs 49*a*–49*c* laid by penetrating the posture correction device 8 and reduce friction resistance during the posture correction by narrowing the widths of the outer two conveyor belts 49*b* and 49*c*.

As described above, because the apparatus is in a structure without the first stepping motor 54 mounted to the support frame 34 for rotating the correction roller pairs 37 and 38, these rollers can be rotated at a high speed by making the moment of inertial of the support frame 34 small. Accordingly, even if a bank note has much shift and skew, its posture can be corrected easily using the less number of correction roller pairs and cheap stepping motors.

Further, as the second stepping motor 48 is installed close to the rotating center of the support frame 34, the length of the driving belt 46 for rotating and driving the support frame 34 including the correction roller pairs 37 and 38 can be made short. Accordingly, the vibration of the driving belt 46 when stopping the second stepping motor 46 can be reduced and correction accuracy can be improved. Furthermore, a time required until the support frame 32 is started to rotate in the reverse direction can be made short and the correction process at higher speed becomes possible.

Further, if it is not possible to make the length of a driving belt for driving the support frame 32 including the correction roller pairs 37 and 38 for the limited space for the apparatus short, an idle roller 71 for adjusting the belt tension is installed at the middle of the rotary shaft of the second stepping motor 48 and the rotating central distance of the support frame 32. As a result, it becomes possible to reduce the vibration of the driving belt 46 when stopping the second stepping motor 48 and improve correction accuracy. Accordingly, a time required till the support frame 32 starts to rotate in the reverse direction becomes short and the process at a higher speed becomes possible.

Further, when bank notes to be classified and arranged are in various sizes and inserted into the insert port 2 in the not uniform state, the position of one side end of a shifted bank note could not be detected so far in some cases. On the contrary, as the light sensor array 70 is provided for the whole area of the conveying width at the bank note introducing side of the conveying belt in this invention, the positions of both side ends of bank notes can be always detected. Accordingly, a shift amount of a bank note can be calculated from its length in the longitudinal direction and a posture can be corrected precisely.

Further, in the posture correction device 8, the first to third conveyor belts pairs 49*a*–49*c* are laid, the correction roller pairs 37 and 38 are provided between the first and second conveyor belt pairs 49*a* and 49*b* and the first and third conveyor belt pairs 49*a* and 49*c*, respectively. These correction roller pairs 37 and 38 are arranged symmetrically against the conveying center line. It is therefore possible to reduce conveying resistance at the outside of the correction roller pairs 37 and 38 and prevent generation of bending of corners and wrinkles of bank notes during the posture correction Further, as two outside conveyor belt pairs 49*b* and 49*c* of the first to third conveyor belt pairs 49*a*–49*c* laid by penetrating the posture correction device are installed at such the positions as the end surface of a bank note in the minimum size that is handled by the device does not come out to the conveying center line side from the conveyor belts, it is possible to prevent generation of conveying jam, bending of corners and wrinkles during the correction of shift and skew.

Further, the two outside conveyor belt pairs 49*b* and 49*c* of the first to third conveyor belt pairs 49*a*–49*c* are not made in pairs but left as belt portions 49*b*1 and 49*c*1 only for supporting the lower surface sides of bank notes, and thus, it is possible to reduce friction resistance and prevent generation of bending of corners and wrinkles even when paper stiffness is weak.

Further, because a clearance d is formed between the belt portions 49*b*2 and 49*c*2 of two conveyor belt pairs 49*b* and 49*c* at the outside of the first to third conveyor belt pairs 49*a*–49*c* laid by penetrating the posture correction device 8, it is possible to reduce friction resistance and prevent generation of bending of corners and wrinkles even when paper stiffness is weak. In addition, it is possible to prevent bank notes from being turned over and bent when entering into the roller 89 after the posture correction.

As described above, the first driving means for rotating the correction roller pairs is provided separately from the support frame in this invention, the moment of rotations of the support frame can be made small. Accordingly, it is possible to rotate the support frame including correction roller pairs at a high speed and the correction process of paper-like material having much skew and shift becomes possible without installing the support frame including roller pairs at multiple stages as before. Therefore, the apparatus can be made small in size, operated using cheap stepping motors without requiring an expensive servomotor and reduce required cost.

What is claimed is:

1. A posture correction device comprising:

a detector configured to detect a posture of conveyed a sheet which has a first surface and a second surface in the opposite side of the first surface; and a posture correction mechanism configured to correct the posture of the sheet according to the posture of the sheet detected by the detector, wherein the posture correction mechanism includes:

a plurality of roller pairs including a first roller pair contacting with the first surface of the sheet and a second roller pair contacting with the second surface of the sheet to clamp the sheet between the first and second roller pairs and convey the sheet by rotation of the first and second roller pairs;

a support frame configured to support the first and second roller pairs;

a first driving mechanism, provided away from the support frame, configured to rotate and drive the first roller pair; and a second driving mechanism configured to tilt the first and second roller pairs simultaneously by a prescribed angle in the conveying direction of the sheet by rotating the support frame.

2. A posture correction device according to claim 1, wherein the posture correction mechanism corrects at least an angular shift in the direction orthogonal to the conveying direction of the sheet.

3. A posture correction device according to claim 1, wherein the posture correction mechanism corrects at least both side positional shift in the conveying direction of the sheet.

4. A posture correction device according to claim 1, wherein the posture correction mechanism corrects at least a both side positional shift in the conveying direction of the sheet and an angular shift in the direction orthogonal to the conveying direction.

5. A posture correction device according to claim 1, wherein the first driving mechanism has a first drive shaft configured to rotate the correction roller pair by rotating around an intersecting point of the center line of a conveying path configured to convey the sheet with the shaft line of the roller pair, and the second driving mechanism has a second drive shaft configured to rotate the support frame by rotating around the same intersecting point of the first drive shaft.

6. A posture correction device according to claim 5, wherein the second driving mechanism has a driving motor that is connected to the second drive shaft by way of a driving belt and the driving motor is installed directly below the conveying path.

7. A posture correction device according to claim 5, wherein the second driving mechanism has a driving motor that is connected to the second drive shaft by way of a driving belt and the middle portion of the driving belt is put over an idle pulley.

8. A sheet processing apparatus comprising:

an insert port configured to accommodate sheet in a lump;

a take-out mechanism configured to take out sheet accommodated in the insert port one by one sheet;

a conveying mechanism configured to convey the sheet taken out by the take-out mechanism along the conveying path;

a detector configured to detect a posture of a sheet, which has a first surface and a second surface in the opposite side of the first surface, conveyed by the conveying mechanism;

a posture correction mechanism configured to correct the posture of the sheet according to the posture of the sheet detected by the detector; and a classifying mechanism configured to classify the sheet after the posture has been corrected by the posture correction mechanism according to classification information; wherein the posture correction mechanism includes:

a plurality of roller pairs including a first roller pair contacting with the first surface of the sheet and a second roller pair contacting with the second surface of the sheet to clamp the sheet between the first and second roller pairs and convey the sheet by rotation of the first and second roller pairs;

a support frame configured to support the first and second roller pair;

a first driving mechanism, provided away from the support frame, configured to rotate and drive the first roller pair; and a second driving mechanism configured to tilt the first and second roller pairs simultaneously by a prescribed angle in the conveying direction of the sheet by rotating the support frame.

9. A sheet processing apparatus according to claim 8, wherein the posture correction mechanism corrects at least angular shift in the direction orthogonal to the sheet conveying direction.

10. A sheet processing apparatus according to claim 8, wherein the posture correction mechanism corrects at least both side positional shifts in the direction of the sheet.

11. A sheet processing apparatus according to claim 8, wherein the posture correction mechanism corrects at least both side positional shifts in the conveying direction of the sheet and angular shifts in the direction orthogonal to the conveying direction.

12. A sheet processing apparatus according to claim 8, wherein the first driving mechanism has a first drive shaft configured to rotate the first roller pair by rotating around the intersecting point of the center line of the sheet conveying path with the shaft line of the roller pair, and a second driving mechanism has a second drive shaft configured to rotate the support frame by rotating the same intersecting center as the first drive shaft.

13. A sheet processing apparatus according to claim 12, wherein the second driving mechanism has a driving motor that is connected to the second drive shaft by way of a driving belt and the driving motor is installed directly below the conveying path.

14. A sheet processing apparatus according to claim 12, wherein the second driving mechanism has a driving motor that is connected to the second drive shaft by way of a driving belt and the middle portion of the driving belt is put over the idle pulley.

15. A sheet processing apparatus according to claim 8, wherein the conveying mechanism has a first conveyor belt pair that is provided at the center of the conveying path, a second and a third conveyor pairs that are arranged at the symmetrical positions at both sides of first conveyor belt pair; and the detector has transmission light sensors configured to detect the posture state of the sheet, and the light sensors are arranged over the whole area of the conveying width other than the width of the first conveyor belt pair at the sheet introducing sides of the first through the third conveyor belt pairs.

16. A sheet processing apparatus according to claim 15, wherein one roller of the first roller pair and one roller of the second roller pair are provided between the first and second conveyor belt pairs and another roller of the first roller pair and another roller of the second roller pair are provided between the first and third conveyor belt pairs, respectively and the one roller of the first roller pair and the one roller of the second roller pair, and the another roller of the first roller pair and the another roller of the second roller pair are arranged symmetrically at both sides of the first conveyor belt pair.

17. A sheet processing apparatus according to claim 16, wherein when a minimum size sheet is placed near the edge of the width of the conveying path, the position of the edge of the inside of the conveying path of the second and third conveyor belt pairs arranged at the outside of the first and second roller pairs is in the inner side of the conveying path than the edge of this minimum size sheet.

18. A sheet processing apparatus according to claim 15, wherein the parts of the second and third conveyor belt pairs in the area configured to correcting the posture of the sheet are individual belt portions supporting the lower side of the sheet.

19. Sheet processing apparatus according to claim 15, wherein the parts of the second and third conveyor belt pairs in the area configured to correcting the posture of the sheet form a clearance between the belt portions and rotate at the same speed as the conveying speed of the sheet.

* * * * *